US005879848A

United States Patent [19]

Kurose et al.

[11] Patent Number: 5,879,848

[45] **Date of Patent: *Mar. 9, 1999**

[54] TONER FOR FULL COLOR DEVELOPING

[75] Inventors: Katsunori Kurose, Amagasaki; Masayuki Hagi, Takatsuki; Takeshi Arai, Amagasaki; Junichi Tamaoki, Sakai; Ichiro Demizu, Toyonaka; Hiroyuki Fukuda, Kobe, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 606,436

[22] Filed: Feb. 23, 1996

[30] Foreign Application Priority Data

Feb. 24, 1995 [JP] Japan ..... 7-062139

[51] Int. Cl.[6] ..... G03G 9/087

[52] U.S. Cl. ..... 430/109; 430/45; 430/106; 430/110; 430/111

[58] Field of Search ..... 430/45, 109, 106, 430/111, 110

[56] References Cited

U.S. PATENT DOCUMENTS

| | | | |
|---|---|---|---|
| 4,590,139 | 5/1986 | Imai et al. | 430/45 |
| 5,049,467 | 9/1991 | Yamanaka | 430/110 |
| 5,126,221 | 6/1992 | Chiba et al. | 430/45 |
| 5,272,040 | 12/1993 | Nakasawa et al. | 430/110 |
| 5,300,383 | 4/1994 | Tsubota et al. | 430/45 |
| 5,314,773 | 5/1994 | Kubo et al. | 430/45 |
| 5,429,898 | 7/1995 | Sugitaki et al. | 430/45 |

OTHER PUBLICATIONS

Grant et al. ed. Grant & Hackh's Chemical Dictionary, Fifth Ed, McGraw–Hill Book Company, NY (1987) p. 24.

*Primary Examiner*—Janis L. Dote
*Attorney, Agent, or Firm*—Burns, Doane, Swecker & Mathis, LLP

[57] ABSTRACT

A developer contains a set of color toners and black toner for use in a full color image forming apparatus. Each of the color toners contains a color colorant and a first binder resin, and the black toner contains a black colorant and a second binder resin. The difference between softening point and flow starting temperature of said first binder resin is less than the difference between softening point and flow starting temperature of said second binder resin.

23 Claims, 1 Drawing Sheet

TONER FOR FULL COLOR DEVELOPING

BACKGROUND OF THE INVENTION

1. Field of the Invention

The present invention relates to a toner for use in a full color image forming apparatus.

2. Description of the Related Arts

Conventionally, full color image forming apparatuses such as full color copying machines, full color printers and the like form full color images using color toners such as cyan toner, magenta toner, and yellow toner in addition to black toner.

Various types of methods are used in full color image forming apparatuses. Among these methods it is typical that an electrostatic latent image is formed on the charged surface of a photosensitive member via optical exposure by a laser beam or the like, and said latent image is developed using specific toner selected among cyan, magenta, yellow, and black toners, said developed toner images being superimposed one upon another to produce a full color image.

In the aforesaid type of full color image forming apparatus, monochrome images are formed using only black toner.

Heretofore, identical binder resins have been used for color toners and black toners alike in the aforesaid full color image forming apparatus.

Black toner alone is frequently used when forming monochrome images rather than full color images. When black toner is formed using the same binder resin as is used for color toner and the black toner is frequently used alone, the black toner is rapidly fatigued in comparison to the other color toners. Furthermore, when black toner is formed using the same binder resin as is used for color toner, the gloss of the black portions of an image formed by said black toner is overly enhanced. Thus, when forming full color images, only the black portions are prominent due to over enhancement, such that there is discordance between said black portions and other portions formed by other color toners.

SUMMARY OF THE INVENTION

An object of the present invention is to provide a set of full color toners including black toner capable of excellent image formation in a full color image forming apparatus.

Another object of the present invention is to provide a set of full color toners capable of excellent image formation without discordance between black toner and other color toners in a full color image forming apparatus.

Still another object of the present invention is to provide a set of full color toners wherein the black toner does not fatigue more rapidly than the other color toners even with monochrome image formation in a full color image forming apparatus.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
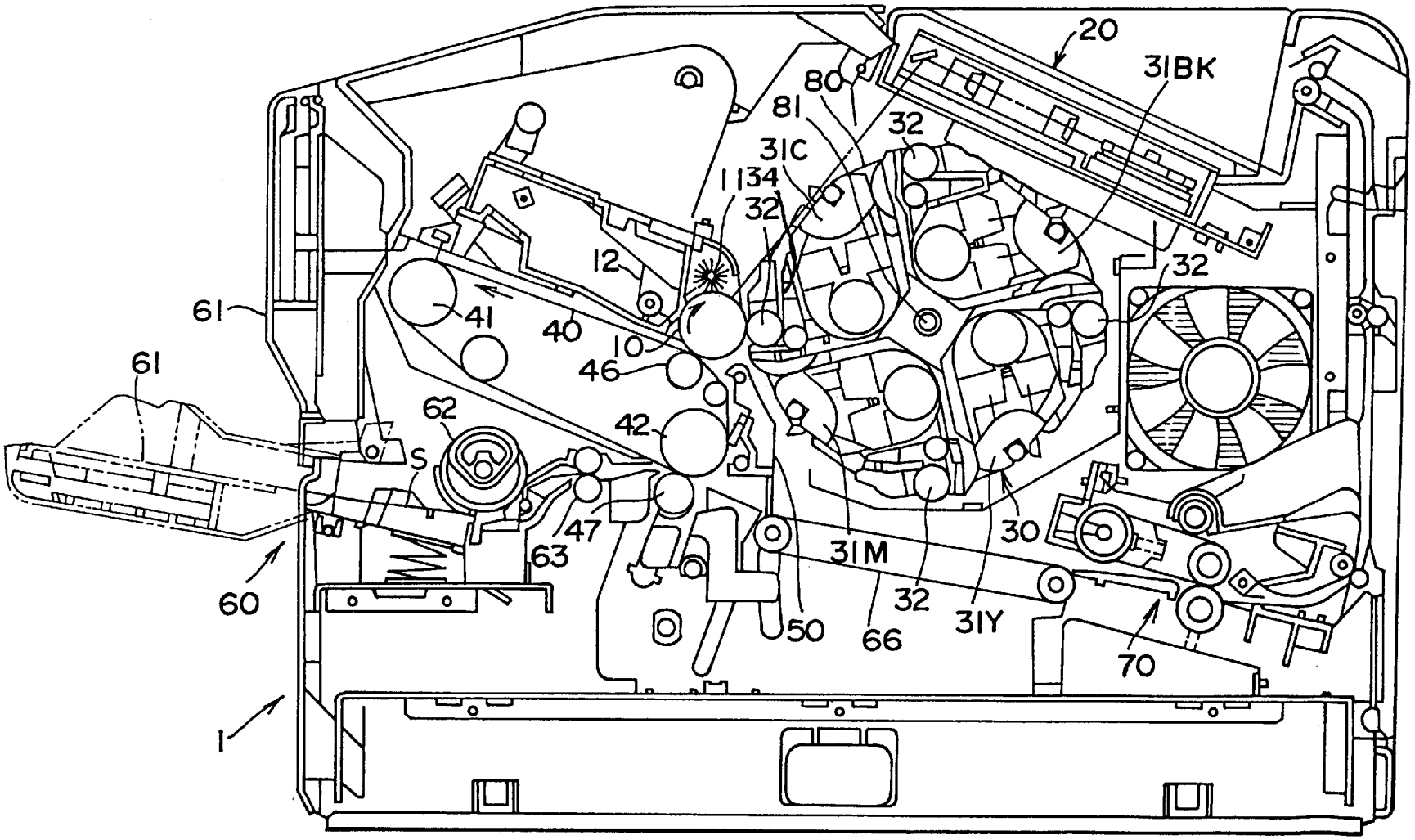
FIG. 1 is a brief section view of a full color image forming apparatus 1 for forming full color images.

To eliminate the previously described disadvantages, the present invention uses, in a full color developer containing a set of color toners and black toner for use in a full color image forming apparatus, color developers containing toner having color colorant and a first binder resin, and a black developer containing a toner having a black colorant and a second binder resin, wherein the difference of the softening point and flow starting temperature of said first binder resin is less than the difference of the softening point and flow starting temperature of said second binder resin.

The durability of the black toner is higher than that of the color toner by selecting binder resins such that the difference of the softening temperature and the flow starting temperature of the first binder resin is less than the difference of the softening point and flow starting temperature of the second binder resin, thereby preventing the black toner from fatiguing more rapidly than the other full color toners even in the case of monochrome image formation.

Specifically, the previously described disadvantages are eliminated, in toners used for full color developing in full color image forming apparatuses which form full color images by developing each specific color using cyan, magenta, yellow, and black toner, by providing that the flow starting temperature $Ti_1$ of the binder resin in each of the color toners, i.e., cyan, magenta, and yellow toners, is in the range of 80°~100° C., and the softening point $Tm_1$ is in the range of 90°~120° C., and the difference $\Delta T_1$ between the softening point $Tm_1$ and the flow starting temperature $Ti_1$ ($\Delta T_1=Tm_1-Ti_1$) is in the range of 10°~20° C., and providing that the flow starting temperature $Ti_2$ of the binder resin of the black toner is in the range of 90°~110° C., the softening point $Tm_2$ is in the range of 110°~130°, and the difference $\Delta T_2$ between the softening point $Tm_2$ and the flow starting temperature $Ti_2$ ($\Delta T_2=Tm_2-Ti_2$) is in the range of 15°~30° C., and further providing that the difference between $\Delta T_2$ of the black toner and $\Delta T_1$ of the color toners (i.e., $\Delta T_2-\Delta T_1$) is in the range of 3°~13° C.

The flow starting temperatures $Ti_1$ and $Ti_2$ and the softening points $Tm_1$ and $Tm_2$ of the binder resins used in the color toners and black toner were measured using a flow tester (model CFT-500; Shimadzu); 1.0 g samples were weighed and the parameters were measured using a 1.0×1.0 mm nozzle under conditions of a temperature elevation rate of 3.0° C./min, preheating time of 180 sec, load application of 30 kg, and measured temperature range of 60°~140° C. The temperature at which the sample started to flow was designated the flow starting temperature Ti, and the temperature at which ½ the sample flowed was designated the softening point Tm.

The binder resin used in the color toners comprising cyan toner, magenta toner, and yellow toner, has a flow starting temperature $Ti_1$ of 80°~100° C., and a softening point $Tm_1$ of 90°~120° C. High-temperature offset readily occurs when the flow starting temperature $Ti_1$ is lower than 80° C., or the softening point $Tm_1$ is lower than 90° C. When the flow starting temperature $Ti_1$ is higher than 100° C., the fixing strength of these toners is reduced. When the softening point $Tm_1$ is higher than 120° C., the heat-fusion characteristics during fixing are reduced and cause reduced fixing strength, as well as reduced color mixing of the toners as appearing in the glossiness and light-transmittance of the full color image, thereby preventing the production of excellent full color images. The binder resin preferably has a flow starting temperature $Ti_1$ of 80°~95° C., and a softening point of 95°~115° C.

The aforesaid binder resin has a difference $\Delta T_1$ between the softening point $Tm_1$ and the flow starting temperature Ti (i.e., $\Delta T_1=Tm_1-Ti_1$) of 10°~20° C. When this difference $\Delta T_1$ is less than 10° C., high-temperature offset readily occurs, whereas when this difference $\Delta T_1$ is greater than 20° C., toner light-transmittance and color mixing are reduced. A binder resin having a difference $\Delta T_1$ of 10°~15° C. is desirable.

The binder resin used in the black toner, on the other hand, has a flow starting temperature $Ti_2$ of 90°~110° C., and a softening point $Tm_2$ of 110°~130° C. When the flow starting temperature $Ti_2$ of the binder resin is lower than 90° C., or the softening point $Ti_2$ is lower than 110° C., the strength of the binder resin is reduced, such that the durability of the obtained toner is adversely affected. Furthermore, when the flow stating temperature $Ti_2$ is higher than 110° C., or the softening point $Tm_2$ is higher than 130° C., heat-fusion characteristics during fixing are reduced, thereby causing reduced fixing strength, as well as reduced glossiness. A binder resin having a flow starting temperature $Ti_2$ of 95°~105° C., and a softening point $Tm_2$ of 115°~130° C. is desirable.

The binder resin has a difference $\Delta T_2$ between the softening point $Tm_2$ and the flow starting temperature $Ti_2$ (i.e., $\Delta T_2=Tm_2-Ti_2$) of 15°~30° C. When the difference $\Delta T_2$ is less than 15° C., the durability of the black toner is adversely affected. Furthermore, when the difference $\Delta T_2$ is greater than 30° C., the gloss of the black toner is reduced, so as to cause discordance relative to the gloss of the other color toners. A binder resin having a difference $\Delta T_2$ of 20°~30° C. is desirable.

The difference $(\Delta T_2-\Delta T_1)$ between the difference $\Delta T_2$ of the black toner binder resin and the difference $\Delta T_1$ of the color toner binder resin is 3°~13° C. When this difference $(\Delta T_2-\Delta T_1)$ is greater than 13° C., the black toner becomes difficult to fuse during fixing compared to the color toners, resulting in a marked difference between the gloss of the black image formed by the black toner and the gloss of the color images formed by the color toners, which produces discordance in the gloss of full color images. Furthermore, when the aforesaid difference $(\Delta T_2-\Delta T_1)$ is less than 3° C., the gloss of the black image portion within the full color image is too intense, the durability of the black toner is about the same as the durability of the color toner, and the service life of the black toner is shortened when many monochrome images are formed such as text document images and the like. For example, when using a developing device of a monocomponent developing type wherein the amount of toner transported by a toner-carrying member is regulated by a toner regulating member which also charges said toner, the service life of the black toner is reduced, the black toner flocculates and adheres to the toner regulating member and toner-carrying member, thereby causing defects in the formed image. When a using a developing device of a two-component developing type wherein the toner is mixed with a carrier, the service life of the black toner is reduced, and the toner adheres to the carrier, the carrier becomes spent and does not adequately charge the toner due to fatigue, thereby causing fog in the formed image.

Examples of useful binder resins for use in the aforesaid toners include epoxy resin styrene-acrylic resin, polyester resin and the like, although polyester resins are desirable from the perspectives of resin durability and light-transmittance.

Polyester resins containing at least a polyoxypropylene-bisphenol A component, polyoxyethylene-bisphenol A component and an aromatic discarboxylic acid component are useful binder resins for use in the aforesaid toners.

It is desirable that ether diphenol is used in the alcohol component and aromatic dicarboxylic acid is used in the acid component of the aforesaid polyester resin so as to obtain suitably sharp melting characteristics, light-transmittance, and color mixing, as well as adequate strength and heat resistance.

Examples of useful ether diphenols of the alcohol component include polyoxypropylene(2.2)-2,2-bis(4-hydroxyphenyl)propane,
polyoxypropylene(3.3)-2,2-bis(4-hydroxyphenyl)propane,
polyoxyethylene(2.0)-2,2-bis(4-hydroxyphenyl)propane,
polyoxypropylene(2.0)-2,2-bis(4-hydroxyphenyl)propane,
polyoxypropylene(2.0)-polyoxyethylene(2.0)-2,2-bis(4-hydroxyphenyl)propane,
polyoxypropylene(6)-2,2-bis(4-hydroxyphenyl)propane and the like.

In order to adjust the glass transition temperature and softening point of the aforesaid polyester resin, other alcohol components may be added in small amounts in addition to the ether diphenol, e.g., diols such as ethylene glycol, diethylene glycol, triethylene glycol, 1,2-propylene glycol, 1,3-propylene glycol, 1,4-butane diol, neopentyl glycol and the like; and polyhydric alcohols such as sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

On the other hand, aromatic dicarboxylic acids such as terephthalic acid, isophthalic acid and the like, acid anhydrides thereof, as well as lower alkylester thereof may be used as the aforesaid aromatic dicarboxylic acid.

In order to adjust the glass transition temperature and softening point of the aforesaid polyester resin, in addition to the aforesaid aromatic dicarboxylic acids, aliphatic dicarboxylic acids such as, for example, fumaric acid, maleic acid, succinic acid, alkylsuccinic acid and alkenylsuccinic acid having 4~18 carbon atoms, and acid anhydrides thereof as well as lower alkenyl esters maybe added in small amounts.

In order to adjust the acid value of the aforesaid polyester resin and improve the strength of said resin, small amounts of additional constituents may be added in addition to the aforesaid materials within a range which does not impair toner light-transmittance, for example, polyatomic carboxylic acids such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxy propane, 1,2,4-cyclohexanetricarboxylic acid, tetra(methylenecarboxyl) methane, 1,2,7,8-octanetetracarboxylic acid, pyromellitic acid, anhydrides thereof and lower alkylesters thereof. Black toner does not require special consideration for light-transmittance.

Urethane-transformed polyester resin obtained by reacting isocyanate with polyester resin may be used, and is particularly suited for use as the binder resin of the black toner. Use of such resin provides the black toner with a softening point higher than that of the color toner, as well as adequate strength for the black toner.

In the toners used for full color developing in the present invention, suitable colorants may be added to the binder resins so as to obtain the respective colors for cyan toner, magenta toner, yellow toner, and black toner, for example, the various cyan, magenta, yellow, and black colorants described below may be used, although usable colorants are not specifically limited to those listed hereinafter.

Examples of usable magenta colorants include magenta pigments such as C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, 209 and the like, and magenta dyes such as C.I. solvent red 1, 3, 8, 23, 24, 25, 27, 30, 49, 81, 82, 83, 84, 100, 109, 121, C.I. disperse red 9, C.I. basic red 1, 2, 9, 12, 13, 14, 15, 17, 18, 22, 23, 24, 27, 29, 32, 34, 35, 36, 37, 38, 39, 40 and the like.

Examples of useful cyan colorants include cyan pigments such as C.I. pigment blue 2, 3, 15, 16, 17 and the like.

Examples of useful yellow colorants include C.I. pigment yellow 1, 2, 3, 4, 5, 6, 7, 10, 11, 12, 13, 14, 15, 16, 17, 23, 65, 73, 83, C.I. vat yellow 1, 3, 20 and the like, and yellow dyes such as C.I. solvent yellow 79, 162 and the like.

Examples of useful black colorants include carbon black and the like.

In each of the aforesaid toners used for full color developing, and particularly the cyan toner, magenta toner, and yellow toner, colorants with improved dispersibility via a flashing process are used to achieve uniform dispersion of the respective colorants in the binder resin. Furthermore, master batch processing may be used wherein master batches are produced which have colorants dispersed beforehand in the binder resin, said master batch being kneaded with the binder resin to disperse the colorant in the binder resin.

The amount of colorant contained in the binder resin is desirably 2~15 percent-by-weight relative to 100 parts-by-weight of binder resin. That is, when the amount of added colorant is within the aforesaid range, the color toner in particular have adequate light-transmittance, and are suitable for developing OHP film and the like.

In the toner used for full color developing of the present invention, various additives in addition to the previously described colorants may be added to the binder resin, such as charge controllers, post-process agents and the like used to improve toner flow characteristics and adjust toner charge characteristics.

Colorless, white, or light color charge controllers may be used insofar as they do not adversely affect coloration or light-transmittance of the various color toners. Examples of useful charge controllers include salicylic acid derivative, zinc and like metals, salicylic acid metal complex, calix arene compounds, boron compounds, quaternary ammonium salt with fluorine and the like used individually or in combination.

Usable materials include, for example, the salicylic acid metal complex disclosed in U.S patent application Ser. Nos. 4,206,064 and 4,762,763; the calix arene compounds disclosed in U.S patent application Ser. No. 5,049,467; the boron compounds disclosed in Japanese Unexamined Patent Application No. HEI 2-221967; the quaternary ammonium salt with fluorine disclosed in U.S. patent application Ser. No. 5,069,994 and the like. In order to improve adjustment of the amount of toner charge and charge rise characteristics, quaternary ammonium salt with fluorine may be used in conjunction with charge controllers such a s salicylic acid metal complex, calix arene compound and the like.

The charge controller is normally added in an amount of 0.1~10 parts-by-weight, and preferably 0.5~5 parts-by-weight, relative to 100 parts-by-weight of binder resin so as to adequately bond the charge controller to the binder resin.

Examples of usable post-process agents include silica, alumina, titania, tin oxide, zirconium oxide and the like used individually or in combinations of two or more. In the aforesaid post-process agents, it is desirable that hydrophobic processing be used to improve environmental stability. Examples of useful hydrophobic agents include various coupling agents such as silane, titanate, aluminum, zirco-aluminate and the like, and si licon oil and the like. From the perspective of environmental stability relative to chargeability and flow characteristics of the toner, it is particularly desirable that hydrophobic silica and hydrophobic titania, or hydrophobic silica and hydrophobic alumina are used in combination as a post-process agent. The amount of added post-process agents is desirably 0.2~3.0 percent-by-weight relative to the toner to improve toner flow characteristics and prevent adverse affects by free post-process agent.

In one embodiment of the invention, post process particles are included in the cyan toner, the magenta toner and the yellow toner, and are different from the post-treatment particles included in the black toner. The post process particles included in the cyan toner, the magenta toner and the yellow toner are selected from the group consisting of titania, mixture of titania and silica and mixture of alumina and silica and the post process particles included in the black toner are selected from the group consisting of titania, silica and alumina.

It is desirable, from the perspectives of production cost and production stability, that the toner for full color developing of the present invention is produced by kneading and pulverization.

When producing toner by kneading and pulverization, the aforesaid various additives are added as needed to the colorant and polyester resin, the mixture is mixed by a mixing device such as a henschel mixer or the like, the mixture is cooled after being fused and kneaded, and is subsequently coarsely pulverized and the coarse particles are finely pulverized, and the fine particles are classified to obtain the toner. It is desirable that, during production, the volume-average particle size of the toner particles is adjusted so as to be within a range of 5~10 $\mu$m, from the perspective of improving the reproducibility of fine image.

Although the toner for full color developing of the present invention may be used in combination with a carrier as a toner for two-component developing, or without a carrier as a toner for monocomponent developing, use with a monocomponent developing method is more effective for forming flat solid images with scant edge effect.

It is desirable that nonmagnetic monocomponent toner be used inasmuch as when magnetic toner is used in monocomponent developing methods, a typically black colored magnetic powder is added, such that the hue of cyan, magenta, and yellow color toner is reduced so as to decrease the sharpness and color tone of the obtained full color image. Either magnetic or nonmagnetic toner may be used as a black toner since hue is not affected.

The toner for full color developing of the present invention may be used in full color image forming apparatuses wherein, for example, an electrostatic latent image formed on the uniformly charged surface of a photosensitive member by a writing means such as irradiation by a laser beam or the like, and said latent image is developed by a predetermined toner selected from among magenta toner, cyan toner, yellow toner, and black toner. The developed toner images are sequentially superimposed one upon another on an intermediate transfer member and the superimposed toner images transferred to a recording medium, and subsequently fixed thereon, or the developed toner images are sequentially transferred to a recording medium supported on an intermediate transfer member, and subsequently fixed thereon. Alternatively, the overlaid toner images may be formed on a photosensitive member, transferred to a recording sheet and fixed thereon. From the perspective of compact design, image forming apparatuses among the aforesaid apparatus may use methods to transfer and overlay each toner image on an intermediate transfer member. It is particularly desirable from the perspective of compactness that the apparatus use transfer rollers for the transfer from the photosensitive member to an intermediate transfer member and from the intermediate transfer member to a recording medium. Examples of such full color image forming apparatuses are disclosed in U.S. patent application Ser. Nos. 5,189,478, and 5,014,095, and 5,157,507, and 4,705,385.

In the aforesaid full color image forming apparatuses, more rapid fatiguing of the black toner compared to the color toners can be prevented by using the previously described binder resin in each of the color toners and the aforesaid binder resin in the black toner under the previously described conditions, respectively. When forming full color images, differences in gloss and the like are very slight between the color image portion formed by the color toners and the black image portions formed by the black toner.

Although specific examples of the present invention are described hereinafter, the invention is not limited to the following examples.

Polyester resins A~E manufactured as described below were used as the binder resin in the various toners of the examples and reference examples.

Polyester Resins A and B

Polyester resins A and B were produced as follows. Polyoxypropylene(2.2)-2,2-bis(4-hydroxyphenyl)propane (hereinafter referred to as "PO"), polyoxyethylene(2.0)-2,2-bis(4-hydroxyphenyl)propane (hereinafter referred to as "EO"), and terephthalic acid (hereinafter referred to as "TPA") were combined to achieve a molar ratio of 3:7:9. The mixture was introduced into a 2 liter four-mouth flask to which a reflux condenser, a moisture separator, a nitrogen gas tube, a thermometer, and a mixing device were attached. A reaction was induced by heating and mixture the mixture as nitrogen gas was introduced to the flask via the nitrogen gas tube. The acid values of the materials were measured during the reaction and the reaction conditions were followed until predetermined acid values were attained, at which time the reactions were terminated so as to obtain polyester resins A and B having the softening point Tm and flow starting temperature Ti values as indicated in Table 1 below.

Polyester Resin C

Polyester resin C was produced in the same manner as polyester resins A and B via the reaction described above with the exception that PO, EO, fumaric acid, and TPA were mixed in a molar ratio of 5:5:5:4, so as to obtain a polyester resin C having the softening point Tm and flow starting temperature Ti indicated in Table 1 below.

Polyester Resin D

Polyester resin D was produced as described below. A reflux condenser, a moisture separator, a nitrogen gas tube, a thermometer, and a mixing device were attached to a 5 liter four-mouth flask and installed in a mantle heater; 1,376 g of PO, 659 g of isophthalic acid, and 90 g of diethylene glycol were introduced to the flask and heated to 220°~270° C. as nitrogen was introduced to the flask to induce a dehydration polycondensation reaction and obtain a low-molecular weight polyester resin.

On the other hand, a reflux condenser, a moisture separator, a nitrogen gas tube, a thermometer, and a mixing device were attached to a 5 liter four-mouth flask and installed in a mantle heater; 1,720 g of PO, 1,028 g of isophthalic acid, 328 g of 1,6-dipropyl-1,6-hexanediol, and 74.6 g of glycerine were introduced into the flask and heated to 240° C. as nitrogen gas was introduced into the flask to induce a dehydration polycondensation reaction and obtain a high-molecular weight polyester resin.

To 75 parts-by-weight of the aforesaid low-molecular weight polyester resin were added 25 parts-by-weight of the aforesaid high-molecular weight polyester resin, and after the materials were thoroughly mixed in a henschel mixer, 40 parts-by-weight of diphenylmethane-4,4-diisocyanate was added and the materials were reacted for 1 hr at 120° C. in a pressure kneader. The percentage of NCO was measured to verify the absence of any remaining free isocyanate, so as to obtain a urethane-transformed polyester resin, i.e., polyester resin D, having the softening point Tm and flow starting temperature Ti shown in Table 1 below.

Polyester Resin E

Polyester resin E was produced in the same manner as polyester resin D with the exception that the proportions of the low-molecular weight polyester resin and the high-molecular weight polyester resin was changed, i.e., 60 parts-by-weight low-molecular weight resin and 40 parts-by-weight high-molecular weight polyester resin were used, so as to obtain polyester resin E having the softening point Tm and a flow starting point Ti as indicated in Table 1 below.

The softening points Tm and flow starting temperatures Ti of the aforesaid polyester resins A~E are values measured using a flow tester.

TABLE 1

| | Polyester Resin | | | | |
|---|---|---|---|---|---|
| | A | B | C | D | E |
| Ti | 92 | 92 | 79 | 98 | 103 |
| Tm | 107 | 105 | 91 | 118 | 130 |
| ΔT | 15 | 13 | 12 | 20 | 27 |

The previously described polyester resins A~E were used as binder resins to produce various toners, i.e., cyan toners C1~C4, magenta toners M1~M4, yellow toners Y1~Y4, and black toners B1~B4.

Cyan Toner C1

Cyan toner C1 was produced in the manner described below. The previously described polyester resin A and a cyan colorant (C.I. pigment blue 15-3; Toyo Ink Mfg.) were combined in a ratio of 7:3, kneaded using a pressure kneader, and the kneaded material was pulverized using a feather mill to obtain a pigment master batch.

To 10 parts-by-weight of the pigment master batch were added 93 parts-by-weight of polyester resin A, and 2 parts-by-weight of charge controller comprising salicylic acid-zinc complex (E-84; Orient Chemical Industries), and the materials were mixed in a henschel mixer, then kneaded in a dual-shaft extrusion kneader and cooled, after which the kneaded material was coarsely pulverized by feather mill, finely pulverized by jet mill, and subsequently classified to obtain toner particles having a volume-average particle size of 8.0 $\mu$m.

To the aforesaid toner particles were added 0.8 percent-by-weight of hydrophobic silica (H1303; Hoescht) as an exterior additive, and 1.0 percent-by-weight of hydrophobic titania A having a 60% hydrophobicity and produced as described below. The material was mixed in a henschel mixer in an additive process to obtain cyan toner C1.

The aforesaid hydrophobic titania A was produced as follows. While mixing titania (MT600B; Tayca) having a mean primary particle size of 50 nm in an aqueous system, n-hexyltrimethoxysilane was added to obtain 20 percent-by-weight titania by solid conversion, the material was dried and cracked to obtain hydrophobic titania A having a hydrophobicity of 60%. Hydrophobicity was determined by adding 50 ml of purified water in a 200 ml beaker, adding 0.2 g of measure material, and while mixing the suspension adding via a buret methanol dehydrated by anhydrous sodium sulfate with the end point being the moment no material was observed on the fluid surface, and calculating the degree of hydrophobicity from the amount of methanol used via the equation below.

$$\text{Hydrophobicity}=[\text{amount of methanol}/(50+\text{amount of methanol})]\times 100$$

Cyan Toner C2

Cyan toner C2 was produced in the same manner as cyan toner C1 with the exception that polyester resin B was used instead of the polyester resin A of cyan toner C1.

Cyan Toner C3

Cyan toner C3 was produced in the same manner as cyan toner C1 with the exception that polyester resin C was used instead of the polyester resin A of cyan toner C1.

Cvan Toner C4

Cyan toner C4 was produced by obtaining toner particles using polyester resin A in the same manner as previously described, and adding thereto as exterior additives 0.4 parts-by-weight hydrophobic silica (H1303; Hoescht) and 0.6 parts-by-weight of hydrophobic titania B having a 60% hydrophobicity and obtained in the previously described manner, and mixing said materials using a henschel mixer in an additive process to obtain cyan toner C4.

The aforesaid hydrophobic titania B was produced as follows. A solution of 5 parts-by-weight dimethylpolysiloxane having a viscosity of 500 centistokes at 25° C. dissolved in 50 parts-by-weight xylene was used to spray coat 100 parts-by-weight titania (MT150A; Tayca) having a mean primary particle size of 15 nm, the material was dried, and the obtained titania heated and cracked to obtain hydrophobic titania B having a hydrophobicity of 60%. The hydrophobicity of hydrophobic titania B was measure din the same manner as hydrophobic titania A.

Magenta Toner M1

Magenta toner M1 using polyester resin A was produced in the same manner as cyan toner C1 with the exception that a magenta pigment (C.I. pigment red 184; Dainippon Ink & Chemicals) was used as a colorant.

Magenta Toner M2

Magenta toner M2 was produced in the same manner as magenta toner M1 with the exception that polyester resin B was used instead of the polyester resin A of magenta toner M1.

Magenta Toner M3

Magenta toner M3 was produced in the same manner as magenta toner M1 with the exception that polyester resin C was used instead of the polyester resin A of magenta toner M1.

Magenta Toner M4

Magenta toner M4 using polyester resin A was produced in the same manner as cyan toner C4 with the exception that magenta pigment (C.I. pigment red 184; Dainippon Ink & Chemicals) was used as a colorant.

Yellow Toner Y1

Magenta toner Y1 using polyester resin A was produced in the same manner as cyan toner C1 with the exception that yellow pigment (C.I. pigment yellow 17; Toyo Ink Mfg.) was used as a colorant.

Yellow Toner Y2

Yellow toner Y2 was produced in the same manner as yellow toner Y1 with the exception that polyester resin B was used instead of the polyester resin A of yellow toner Y1.

Yellow Toner Y3

Yellow toner Y3 was produced in the same manner as yellow toner Y1 with the exception that polyester resin C was used instead of the polyester resin A of yellow toner Y1.

Yellow Toner Y4

Yellow toner Y4 using polyester resin A was produced in the same manner as cyan toner C4 with the exception that yellow pigment (17 Toyo Ink Mfg. C.I.; pigment yellow) was used as a colorant.

Black Toner B1

Black toner B1 was produced as follows. A mixture of 100 parts-by-weight polyester resin D, 5 parts-by-weight carbon black (MOGAL L; Cabot), 2 parts-by-weight charge controller (BONTRON S-34; Orient Chemical Industries), and 2.5 parts-by-weight low-molecular weight polypropylene (BISCOL TS-200; Sanyo Chemical Industries) were thoroughly mixed in a henschel mixer, then kneaded by a dual-shaft extrusion kneader. After the kneaded material was cooled, it was coarsely pulverized by feather mill, then finely pulverized by jet mill, and classified to obtain toner particles having a volume-average particle size of 8.0 $\mu$m.

To these toner particles was added 0.5 percent-by-weight hydrophobic silica (TULLAMOX; Talco, Inc.) as an exterior additive, the materials were mixed in a henschel mixer in an additive process to obtain black toner B1.

Black Toner B2

Black toner B2 was produced in the same manner as black toner B1 with the exception that polyester resin E was used instead of the polyester resin D of black toner B1.

Black Toner B3

Black toner B3 was produced in the same manner as black toner B1 with the exception that polyester resin A was used instead of the polyester resin D of black toner B1.

Black Toner B4

Black toner B4 was produced as follows. After obtaining toner particles using polyester resin D in the same manner as described in black toner B1, 0.4 percent-by-weight of hydrophobic silica (H1303; Hoescht) and 0.6 percent-by-weight of the aforesaid hydrophobic titania B were added as exterior additives, the materials were thoroughly mixed in a henschel mixer in an additive process to obtain black toner B4.

Black Toner B5

Black toner B5 was produced as follows. After obtaining toner particles using polyester resin A in the same manner as described in black toner B3, 0.4 percent-by-weight of hydrophobic silica (H1303; Hoescht) and 0.6 percent-by-weight of the aforesaid hydrophobic titania B were added as exterior additives, the materials were thoroughly mixed in a henschel mixer in an additive process to obtain black toner B5.

The aforesaid cyan toner, magenta toner, yellow toners, and black toners were selected from among cyan toners C1~C4, magenta toners M1~M4, yellow toners Y1~Y4, and black toners B1~B5 shown in Table 2, and used to obtain the toners for full color developing of examples 1~4 and reference examples 1~3.

TABLE 2

| | Toner (Polyester Resin) Type | | | |
|---|---|---|---|---|
| | Cyan | Magenta | Yellow | Black |
| Ex. 1 | C1(A) | M1(A) | Y1(A) | B1(D) |
| Ex. 2 | C2(B) | M2(B) | Y2(B) | B1(D) |
| Ex. 3 | C1(A) | M1(A) | Y1(A) | B2(E) |
| Ex. 4 | C4(A) | M4(A) | Y4(A) | B4(D) |
| Ref Ex. 1 | C1(A) | M1(A) | Y1(A) | B3(A) |
| Ref Ex. 2 | C3(C) | M3(C) | Y3(C) | B2(E) |
| Ref Ex. 3 | C4(A) | M4(A) | Y4(A) | B5(A) |

The flow starting temperature $Ti_1$ and softening point $Tm_1$ of the binder resins of the cyan, magenta, and yellow color toners used in the toners for full color developing of the aforesaid examples 1~4 and reference examples 1~3, the difference $\Delta T_1$ between said flow starting temperature $Ti_1$ and said softening point $Tm_1$, and the flow starting temperature $Ti_2$ and softening point $Tm_2$ of the binder resin used in the black toner used in said examples and reference examples, the difference $\Delta T_2$ between said softening point $Tm_2$ and said flow starting temperature $Ti_2$, and the difference $(\Delta T_1-\Delta T_2)$ between said difference $\Delta T_1$ of the color toners and the difference $\Delta T_2$ of the black toner were determined and are shown in Table 3.

TABLE 3

| | $Ti_1$ ($Ti_2$) [°C.] | $Tm_1$ ($Tm_2$) [°C.] | $\Delta T_1$ ($\Delta T_2$) [°C.] | $\Delta T_1 - \Delta T_2$ [°C.] |
|---|---|---|---|---|
| Ex. 1 | 92 | 107 | 15 | 5 |
| | (98) | (118) | (20) | |
| Ex. 2 | 92 | 105 | 13 | 7 |
| | (98) | (118) | (20) | |
| Ex. 3 | 92 | 107 | 15 | 12 |
| | (103) | (130) | (27) | |
| Ex. 4 | 92 | 107 | 15 | 5 |
| | (98) | (118) | (20) | |
| Ref Ex. 1 | 92 | 107 | 15 | 0 |
| | (92) | (107) | (15) | |
| Ref Ex. 2 | 79 | 91 | 12 | 15 |
| | (103) | (130) | (27) | |
| Ref Ex. 3 | 92 | 107 | 15 | 0 |
| | (92) | (107) | (15) | |

The aforesaid toners for full color developing of examples 1~4 and reference examples 1~3 were used for image formation, and the gloss balance in the obtained full color images, durability of the color toners, and durability of the black toners were investigated.

Image formation using the aforesaid toners for color developing of examples 1~4 and reference examples 1~3 was accomplished by accommodating the aforesaid toners in developing devices 31C, 31M, 31Y, and 31Bk of the full color image forming apparatus 30 of the full color printer shown in FIG. 1.

The full color printer of FIG. 1 is provided with a rotatably driven photosensitive drum 10 around the periphery of which are arranged a charger 11 for uniformly charging the surface of the photosensitive drum 10 to a predetermined potential, and a cleaner 12 for removing residual toner from the surface of said photosensitive drum 10.

Furthermore, an optical scanning unit 20 is provided for optically exposing via a laser beam the surface of the photosensitive drum 10 charged by the charger 11. The optical scanning unit 20 is provided with built-in a conventional laser diode, a polygonal mirror, and fθ optical element. The control section of the optical unit receives transferred print data from a host computer for each color cyan, magenta, yellow, and black. The optical scanning unit 20 sequentially outputs laser beams based on the print data of each color and exposes the surface of the photosensitive drum 10, so as to sequentially form an electrostatic latent image of each color on the surface of the photosensitive drum 10.

Full color developing apparatus 30, which accomplishes full color developing by supplying toner of each color to the photosensitive drum 10 upon which is formed the electrostatic latent image, is provided with developing devices 31C, 31M, 31Y, and 31Bk arranged around a shaft 81 and which respectively accommodate the four separate color nonmagnetic monocomponent toners cyan, magenta, yellow, and black. The developing devices 31C, 31M, 31Y, and 31Bk are positioned opposite the photosensitive drum 10 via the rotation of said devices on the shaft 81. Furthermore, in each the developing device 31C, 31M, 31Y, and 31Bk in the developing apparatus 30, a toner regulating members 34 press against the exterior surface of a developing sleeve 32 which transports toner via rotation, and the amount of toner transported by the developing sleeve 32 is regulated by said regulating members 34 which also charge the transported toner.

Each time an electrostatic latent image of each color is formed on the surface of the photosensitive drum 10 by the optical scanning unit 20, the full color developing apparatus 30 is rotated on the aforesaid the shaft 81, such that the developing devices 31C, 31M, 31Y, and 31Bk accommodating the toner of the color corresponding to the latent image are sequentially positioned opposite the photosensitive drum 10, and the developing sleeve 32 of each the developing device 31C, 31M, 31Y, and 31Bk makes contact with the photosensitive drum 10 so as to sequentially supply charged toner of each color to the surface of the photosensitive drum 10 and thereby develop the latent image.

An endless-type rotatably driven intermediate transfer belt 40 is provided as an intermediate transfer member at a position downstream from the full color developing apparatus 30 in the direction of rotation of the photosensitive drum 10. Intermediate transfer belt 40 is driven in rotation synchronously with the photosensitive drum 10. The intermediate transfer belt 40 is pressed by a rotatable primary transfer roller 46 so as to contact with the photosensitive drum 10. A rotatable secondary transfer roller 47 is provided at the region of a support roller 42 which supports the intermediate transfer belt 40, such that a recording medium S such as recording paper or the like is pressed against the intermediate transfer belt 40 by said secondary transfer roller 47.

In a space medial to the full color developing apparatus 30 and the intermediate transfer belt 40 is provided a cleaner 50 for removing residual toner from the surface of the photosensitive drum 10, said cleaner 50 being disposed so as to be capable of making retractable contact with the intermediate transfer belt 40.

A paper supply means 60, which guides a recording medium S such as a recording sheet or the like to the intermediate transfer belt 40, comprises a paper tray 61 for accommodating recording mediums S, a take-up roller 62 for supplying the recording mediums S accommodated in the paper tray 61 one sheet at a time, and a timing roller 63 disposed between the secondary transfer roller 47 and the intermediate transfer belt 40 to transport the recording medium S supplied synchronously with the image formed on the surface of the intermediate transfer belt 40. Thus, the recording medium S transported between the intermediate transfer belt 40 and the secondary roller 47 is pressed against the intermediate transfer belt 40 by said secondary transfer roller 47 so as to pressure transfer the toner image from the intermediate transfer belt 40 to the recording medium S.

On the other hand, the recording medium S which has received the pressure-transferred toner image is guided to a fixing device 70 via a transport means 66 comprising an air suction belt or the like. In the fixing device 70, the toner image is fused onto the recording medium S, and subsequently said recording medium S passes through perpendicular the transport path 80 and is discharged at the top of an apparatus body 1.

During full color image formation using the aforesaid full color printer, the photosensitive drum 10 and the intermediate transfer belt 40 are driven in rotation in their respective directions at identical circumferential speeds and the photosensitive drum 10 is charged to a predetermined potential by the charger 11.

Cyan image exposure on the charged surface of the photosensitive drum 10 is accomplished by the optical scanning unit 20. After an electrostatic latent image of the cyan image has been formed on the photosensitive drum 10 by the aforesaid exposure, the cyan image is developed by supplying cyan toner from the developing device 31C which accommodates cyan toner to the photosensitive drum 10. The intermediate transfer belt 40 is pressed against the photosensitive drum 10 which carries the formed cyan toner image via primary the transfer roller 46, and the cyan toner image is transferred from the photosensitive drum 10 to the intermediate transfer belt 40 in a primary transfer.

After the cyan toner image has been transferred to the intermediate transfer belt 40, the full color developing apparatus 30 is rotated on the shaft 81 to position the developing device 31M which accommodates magenta toner at a position opposite the photosensitive drum 10. In the same manner as for the aforesaid cyan image, a magenta image is optically exposed on the charged surface of the photosensitive drum 10 by the optical scanning unit 20 so as to form an electrostatic latent image thereon which is developed by the developing device 31M which accommodates magenta toner. The developed magenta toner image is transferred from the photosensitive drum 10 to the intermediate transfer belt 40 in a primary transfer. Similarly, the yellow image and black image are exposed, developed, and sequentially transferred in primary transfers, such that the cyan, magenta, yellow, and black toner images are sequentially overlaid on the intermediate transfer belt 40 and form a full color image.

When the final black toner image is transferred to the intermediate transfer belt 40 in a primary transfer, the recording medium S is fed between the secondary transfer roller 47 and the intermediate transfer belt 40 by the timing roller 63. The recording medium S is pressed against the intermediate transfer belt 40 by the secondary transfer roller 47, and the full color toner image formed on the intermediate transfer belt 40 is transferred onto the recording medium S in a secondary transfer.

After the full color toner image has been transferred onto the recording medium S by the secondary transfer, the recording medium S is delivered to the fixing device 70 by the previously mentioned the transport means 66. The fixing device 70 fuses the transferred full color toner image on the recording medium S. Thereafter, the recording medium S passes through perpendicular the transport path 80 and is discharged at the top of the apparatus body 1.

Image formation using each of the toners for full color developing of example 4 and reference example 3 was accomplished by mixing each toner with a carrier produced in the manner described below, and each developer was used to form image in a commercial full color copying apparatus (model CF70; Minolta Co.; Ltd.).

Carrier Production

First, 100 parts-by-weight methylethylketone was added to a 500 ml capacity graduated flask provided with a mixer, condenser, a thermometer, and a nitrogen gas tube. Then, 36.7 parts-by-weight of methylmethacrylate, 5.1 parts-by-weight of 2-hydroxyethylmethacrylate, 58.2 parts-by-weight of 3-methacryloxypropyltris(trimethylsiloxane) silane, and 1 part-by-weight of 1,1'-azobis(cyclohexane-1-carbonitrile) were dissolved in 100 parts-by-weight of methylethylketone at 80° C. under an nitrogen atmosphere. This solution was then titrated into the aforesaid flask over a 2 hr period, and heated for 5 hr to obtain a resin.

After isophorone diisocyanate/trimethylolpropane adduct (IPDI/TMP: NCO%=6.1%) was added to the aforesaid resin in an OH/NCO molar ratio of 1/1, it was diluted with methylethylketone to obtain coating resin fluid having a constant ratio of 3 percent-by-weight.

The aforesaid coating resin solution was applied to a core material comprising sintered ferrite powder (F-300; Powder Tech Co., Ltd.) having a mean particle size of 50 $\mu$m using a spiller coater (Okada Seiko K. K.)to achieve a resin coating of 1.5 percent-by-weight. After drying, this carrier was sintered for 1 hr at 160° C. in an oven with internal air circulation. After the material was cooled, the bulk ferrite powder was cracked using a sieve shaker provided with 106 $\mu$m and 75 $\mu$m screen meshes to obtain a resin coated carrier for mixing with the toners for full color developing of example 4 and reference example 3.

Image formation was accomplished using the toners for full color developing of examples 1~4 and reference examples 1~3, and the gloss balance in the obtained full color images, durability of the color toners, and durability of the black toners were investigated.

The gloss balance of the full color images was evaluated as follows. A full color image was formed using a copier test pattern AR-5 (Data Quest), and the gloss balance between the black image portions and the color image portions in the full color image was visually evaluated. The absence of discordance in the gloss between the black image portion and the color image portion was rated ○, some discordance in the gloss between the black image portion and the color image portion which posed no practical problem was rated Δ, and marked difference in gloss of the two portions (i.e., when the black image was to faint relative to the gloss of the color image portion, or when the gloss of the black image portion was too intense relative to the gloss of the color image portion) was rated X.

Durability of the color toners was determined as follows. In examples 1~3 and reference examples 1 and 2, cyan toners were used in 3,000 image formations, and toner flocculation and adhesion on the toner regulating members and developing sleeve were checked. The absence of flocculation and adhesion was rated ○, slight flocculation or adhesion which posed no practical problem was rated Δ, and toner adhesion which did pose a problem was rated X. Example 4 and reference example 3 were evaluated by using the cyan toner for 3,000 image formations, and visually inspecting the final image. The absence of fog in the image was rated ○, slight fogging which posed no practical problem was rated Δ, and severe fogging was rated X.

Black toner durability was evaluated as follows. The black toners of examples 1~3 and reference examples 1 and 2 were used for 5,000 image formations, and toner flocculation and adhesion on the toner regulating members and developing sleeve were checked. The absence of flocculation and adhesion was rated ○, slight flocculation or adhesion which posed no practical problem was rated Δ, and toner adhesion which did pose a problem was rated X. Example 4 and reference example 3 were evaluated by using the cyan toner for 3,000 image formations, and visually inspecting the final image. The absence of fog in the image was rated ○, slight fogging which posed no practical problem was rated Δ, and severe fogging was rated X.

TABLE 4

| | Example | | | | Reference Example | | |
|---|---|---|---|---|---|---|---|
| | 1 | 2 | 3 | 4 | 1 | 2 | 3 |
| Gloss Balance | ○ | ○ | Δ | ○ | Δ | x | Δ |
| Color Toner durability | ○ | ○ | ○ | ○ | ○ | x | ○ |
| Black Toner Durability | ○ | ○ | ○ | ○ | x | ○ | x |

Although there was no problem with the gloss balance of the toners of full color developing in example 3, there was a slight difference in gloss of the full color image portion and the black image portion. Furthermore, there was no problem in the gloss balance of th e ton er for full color developing of reference examples 1 and 3, the gloss of the black image portion was too intense. On the other hand, in the toner for full color developing of reference example 2, there was a severe problem in gloss difference between the color image portion and the black image portion.

As can be clearly understood from the above results, the toners for full color developing of examples 1~4 produced excellent full color images with only slight gloss difference between the color image portion and black image portion, and the color toners and black toners had excellent durability and provided stable image formation for both color images and monochrome images. In contrast, the toners for full color developing of reference examples 1~3 produced poor quality color images and had marked gloss differences between the color image portions and the black image portion. Color toner and black toner durability was also poor, and stable image formation was not accomplished for full color image or monochrome images.

As described above, the toner for full color developing of the present invention does not suffer from more rapid black toner fatigue than other color toner such as cyan toner even when monochrome images are typically made with great frequency using only the black toner, and there is only slight difference in gloss of color images between the color image portions formed by color toner and black image portions formed by black toner of images when full color images are made.

Thus, when the toner for full color developing of the present invention is used to form images in a full color image forming apparatus, there is no discordance between the color image portions formed by color toner and the black image portion formed by black toner, thereby producing excellent full color images, and stable formation of monochrome images.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A developer for use in full-color image forming apparatus comprising:

a cyan toner which includes a resin binder and cyan colorants;

a magenta toner which includes a resin binder and magenta colorants;

a yellow toner which includes a resin binder and yellow colorants, each resin included in said cyan toner, said magenta toner and said yellow toner having a flow starting temperature $Ti_1$ of 80° C.–100° C. and a softening point $Tm_1$ of 90° C.–120° C., and the difference $\Delta T_1$ between the flow starting temperature $Ti_1$ and the softening point $Tm_1$ being 10° C.–20° C.; and a black toner which includes a resin binder and black colorants, said resin of said black toner having a flow starting temperature $Ti_2$ of 90° C.–110° C. and a softening point $Tm_2$ of 110° C.–130° C., and the difference $\Delta T_2$ between the flow starting temperature $Ti_2$ and the softening point $Tm_2$ being 15° C.–30° C., and $\Delta T_2$ minus $\Delta T_1$ being a positive temperature difference of 3° C.–13° C., said flow starting temperature and said softening point being measured by a flow tester wherein said resin in the black toner is a urethane-modified polyester resin obtained by reaction of a polyester resin with isocyanate.

2. The developer as claimed in claim 1, wherein said resin of each of said cyan toner, said magenta toner and said yellow toner has the flow starting temperature $Ti_1$ of 80° C.–95° C. and the softening point $Tm_1$ of 95° C.–115° C., and the difference $\Delta T_1$ between the flow starting temperature $Ti_1$ and the softening point $Tm_1$ is 10° C.–15° C.

3. The developer as claimed in claim 1, wherein said resin of said black toner has the flow starting temperature $Ti_2$ of 95° C.–105° C. and the softening point $Tm_2$ of 115° C.–130° C., and the difference $\Delta T_2$ between the flow starting temperature $Ti_2$ and the softening point $Tm_2$ is 20° C.–30° C.

4. The developer as claimed in claim 1, wherein said resin included in said cyan toner, said magenta toner and said yellow toner is selected from the group consisting of styrene-acrylic resin, polyester resin and epoxy resin.

5. The developer as claimed in claim 4, wherein said polyester resin is formed from an alcohol component and an acid component, said alcohol component comprising a polyoxypropylene-bisphenol A and a polyoxyethylene-bisphenol A, and said acid component comprising an aromatic dicarboxylic acid.

6. The developer as claimed in claim 5, wherein said polyester resin is formed from the alcohol component and the acid component, said alcohol component comprising a polyoxypropylene-bisphenol A and a polyoxyethylene-bisphenol A, and said acid component comprising an aromatic dicarboxylic acid and an aliphatic dicarboxylic acid.

7. The developer as claimed in claim 6, wherein said polyester resin is formed from the alcohol component and the acid component, said alcohol component comprising a polyoxypropylene-bisphenol A and a polyoxyethylene-bisphenol A, and said acid component comprising an aromatic dicarboxylic acid, an aliphatic dicarboxylic acid and a tri- or tetra-carboxylic acid.

8. The developer as claimed in claim 1, wherein said cyan toner, said magenta toner and said yellow toner are obtained by a first process of forming a master batch by dispersing the colorants to the binder resin, a second process of mixing the master batch and the binder resin, and a third process of pulverizing the mixture of the master batch and the binder resin.

9. The developer as claimed in claim 1, wherein said black toner is obtained by a first process of mixing the binder resin and the colorants, and a second process of pulverizing the mixture of the binder resin and the colorants.

10. The developer as claimed in claim 1, wherein said cyan toner, said magenta toner and said yellow toner include a charge controlling agent which is selected from the group consisting of metal chelates of salicylic acids, calix arene compound, boron compounds and fluorine-containing quaternary ammonium salts.

11. The developer as claimed in claim 1, wherein said cyan toner, said magenta toner, said yellow toner or said black toner includes one or more post-process agent at a content of 0.2–3.0% by weight of said toner.

12. A developer for use in full-color image forming apparatus comprising a toner and a carrier, wherein the toner comprises:

a cyan toner which includes a resin binder and cyan colorants;

a magenta toner which includes a resin binder and magenta colorants;

a yellow toner which includes a resin binder and yellow colorants, each resin included in said cyan toner, said magenta toner and said yellow toner having a flow starting temperature $Ti_1$ of 80° C.–100° C. and a softening point $Tm_1$ of 90° C.–120° C., and the difference $\Delta T_1$ between the flow starting temperature $Ti_1$ and the softening point $Tm_1$ being 10° C.–20° C.; and a black toner which includes a resin binder and black colorants, said resin of said black toner having a flow starting temperature $Ti_2$ of 90° C.–110° C. and a softening point $Tm_2$ of 110° C.–130° C., and the difference $\Delta T_2$ between the flow starting temperature $Ti_2$ and the softening point $Tm_2$ being 15° C.–30° C., and $\Delta T_2$ minus $\Delta T_1$ being a positive temperature difference of 3° C.–13° C., said flow starting temperature and said softening point being measured by a flow tester, said cyan toner, said magenta toner, said yellow toner and said black toner including one or more post-process agents at a content of 0.2–3.0% by weight of said toner, said post-process agent included in the cyan toner, the magenta toner and the yellow toner being different from the post-process agent included in the black toner.

13. The developer as claimed in claim 12, wherein said resin of each of said cyan toner, said magenta toner and said yellow toner has a flow starting temperature $Ti_1$ of 80° C.–95° C. and the softening point $Tm_1$ of 95° C.–115° C., and the difference $\Delta T_1$ between the flow starting temperature $Ti_1$ and the softening point $Tm_1$ is 10° C.–15° C.

14. The developer as claimed in claim 12, wherein said resin of said black toner has a flow starting temperature $Ti_2$ of 95° C.–105° C. and a softening point $Tm_2$ of 115° C.–130° C., and the difference $\Delta T_2$ between the flow starting temperature $Ti_2$ and the softening point $Tm_2$ is 20° C.–30° C.

15. The developer as claimed in claim 12, wherein said one or more post-process agents include in the cyan toner, the magenta toner and the yellow toner are selected from the group consisting of titania, mixture of titania and silica and mixture of alumina and silica, and said one or more post-process agents included in the black toner are selected from the group consisting of titania, silica and alumina.

16. Toners for a mono-component developing method comprising:

a cyan toner which includes a resin binder and cyan colorants;

a magenta toner which includes a resin binder and magenta colorants;

a yellow toner which includes a resin binder and yellow colorants, each resin included in said cyan toner, said magenta toner and said yellow toner having a flow starting temperature $Ti_1$ of 80° C.–100° C. and a softening point $Tm_1$ of 90° C.–120° C., and the difference $\Delta T_1$ between the flow starting temperature $T_1$ and the softening point $Tm_1$ being 10° C.–20° C.; and a black toner which includes a resin binder and black colorants, said resin of said black toner having a flow starting temperature $Ti_2$ of 90° C.–110° C. and a softening point $Tm_2$ of 110° C.–130° C., and the difference $\Delta T_2$ between the flow starting temperature $Ti_2$ and the softening point $Tm_2$ being 15° C.–30° C., and $\Delta T_2$ minus $\Delta T_1$ being a positive temperature difference of 3° C.–13° C., said flow starting temperature and said softening point being measured by a flow tester, said cyan toner, said magenta toner, said yellow toner and said black toner including one or more post-process agents at a content of 0.2–3.0% by weight of said toner, said post-process agent included in the cyan toner, the magenta toner and the yellow toner being different from the post-process agents included in the black toner.

17. The toners as claimed in claim 16, wherein said resin of each of said cyan toner, said magenta toner and said yellow toner has a flow starting temperature $Ti_1$ of 80° C.–95° C. and a softening point $Tm_1$ of 95° C.–115° C., and the difference $\Delta T_1$ between the flow starting temperature $Ti_1$ and the softening point $Tm_1$ is 10° C.–15° C.

18. The toners as claimed in claim 16, wherein said resin of said black toner has a flow starting temperature $Ti_2$ of 95° C.–105° C. and a softening point $Tm_2$ of 115° C.–130° C., and the difference $\Delta T_2$ between the flow starting temperature $Ti_2$ and the softening point $Tm_2$ is 20° C.–30° C.

19. The toners as claimed in claim 16, wherein said cyan toner, said magenta toner and said yellow toner are obtained by a first process of forming a master batch by dispersing the colorants to the binder resin, a second process of mixing the master batch and the binder resin, and a third process of pulverizing the mixture of the master batch and the binder resin.

20. The toners as claimed in claim 16, wherein said black toner is obtained by a first process of mixing the binder resin and the colorants, and a second process of pulverizing the mixture of the binder resin and the colorants.

21. The toners as claimed in claim 16, wherein said cyan toner, said magenta toner and said yellow toner include a charge controlling agent which is selected from the group consisting of metal chelates of salicylic acids, calix arene compound, boron compounds and fluorine-containing quaternary ammonium salts.

22. The toners as claimed in claim 16, wherein said one or more post-process agents included in the cyan toner, the magenta toner and the yellow toner are selected from the group consisting of titania, mixture of titania and silica, and mixture of alumina and silica, and said post-process agents included in the black toner are selected from the group consisting of titania, silica and alumina.

23. The toner as claimed in claim 16, wherein said one or more post-process agents are hydrophobic post-process agents.

* * * * *